US006668577B2

(12) United States Patent
Quenedey

(10) Patent No.: US 6,668,577 B2
(45) Date of Patent: Dec. 30, 2003

(54) INSULATED CONTAINER

(75) Inventor: Jean Patrice Quenedey, Paris (FR)

(73) Assignee: BCF Holding, Paris (FR)

( * ) Notice: Subject to any disclaimer, the term of this patent is extended or adjusted under 35 U.S.C. 154(b) by 0 days.

(21) Appl. No.: 10/077,576

(22) Filed: Feb. 15, 2002

(65) Prior Publication Data

US 2002/0124588 A1 Sep. 12, 2002

(30) Foreign Application Priority Data

Feb. 16, 2001 (FR) ..... 01 02169

(51) Int. Cl.[7] ..... F25D 3/08

(52) U.S. Cl. ..... 62/371; 62/372; 62/457.1; 62/457.2; 62/457.7; 62/530

(58) Field of Search ..... 62/371, 372, 384, 62/457.2, 430, 457.7, 530, 385–388

(56) References Cited

U.S. PATENT DOCUMENTS

| | | | | |
|---|---|---|---|---|
| 2,289,060 A | | 7/1942 | Merkle | 62/1 |
| 4,498,312 A | * | 2/1985 | Schlosser | 62/457.2 |
| 4,576,017 A | | 3/1986 | Combs et al. | 62/372 |
| 4,936,377 A | * | 6/1990 | DeVogel et al. | 165/47 |
| 5,899,088 A | * | 5/1999 | Purdum | 62/371 |
| 6,189,330 B1 | * | 2/2001 | Retallick et al. | 62/371 |
| 6,295,830 B1 | | 10/2001 | Newman | 62/388 |
| 6,308,518 B1 | * | 10/2001 | Hunter | 62/3.3 |
| 6,332,334 B1 | * | 12/2001 | Faryabi | 62/371 |
| 6,401,479 B2 | * | 6/2002 | Garrett | 62/371 |
| 6,415,623 B1 | * | 7/2002 | Jennings et al. | 62/457.2 |
| 6,457,323 B1 | * | 10/2002 | Marotta | 62/371 |

FOREIGN PATENT DOCUMENTS

| | | | |
|---|---|---|---|
| EP | 1074483 | 2/2001 | B65D/81/18 |
| WO | 97/45326 | 12/1997 | B65D/5/06 |

* cited by examiner

*Primary Examiner*—William C. Doerrler
*Assistant Examiner*—Filip Zec
(74) *Attorney, Agent, or Firm*—Allen, Dyer, Doppelt, Milbrath, Gilchrist, P.A.

(57) ABSTRACT

An insulated container for the storage and transport of fresh food items to keep them at a desired temperature, preferably between 0 and 4° C., includes a case provided with an insulating material lining on all its inside faces. The container also includes a diffuser cover provided with an independent refrigeration source connected to a thermal bridge by a support receptacle. The refrigeration source keeps the desired temperature inside the case for a determined period. An insulating cover fits over the diffuser cover to provide thermal insulation for the assembly.

24 Claims, 2 Drawing Sheets

INSULATED CONTAINER

FIELD OF THE INVENTION

The present invention relates to insulated containers, and more particularly, to a portable cooling system for keeping food items cool from a storage location until delivery to the final consumer.

BACKGROUND OF THE INVENTION

Food items include fresh animal or vegetable products, which may or may not have been processed. The temperature of these fresh products should be kept between 0° and 4° C. to preserve them. This temperature should be maintained during transport of these products from the place of purchase from a storage location until they reach the final consumer.

The desired temperature should be strictly adhered to since higher temperatures may cause germs and bacteria to develop, which would make consumption of such products undesirable for the consumer. It is very important to cool fresh food items within the desired temperature range, particularly since home sales and deliveries of such items is becoming an increasingly popular service.

Traditionally, fresh food items are kept at the appropriate temperature in cold rooms during storage, and in refrigerated vehicles. These vehicles are used to transport the fresh food items from their storage location to the customer's home. Products may also be transported by vehicles using insulated containers. In this case, hermetically sealed and pressurized systems are used.

The logistics necessary for this method of delivering fresh products involves special equipment, which may be expensive. In addition, it is necessary for the drivers to have a drivers license for the delivery vehicles. Moreover, this delivery method is not suitable for urban areas since the size of the refrigerated vehicles are hindered by traffic conditions, such as traffic jams. It is difficult for the drivers to deliver products within the expected delivery time.

A major disadvantage of these systems, namely delivery vehicles with cold rooms or hermetically sealed and pressurized containers, is that they cannot enable the user to optimize the cooling system to take into account the storage and transport duration and the quantity of food items to be kept fresh. Thus, with these systems the user cannot optimize and modulate the time during which the cooling system is operational to satisfy their needs.

SUMMARY OF THE INVENTION

In view of the foregoing background, an object of the present invention is to provide an inexpensive, easy to build insulated container capable of preserving fresh food items.

Another object of the present invention is to provide an insulated container that can easily be transported on a lightweight, two or three wheel motor powered vehicle or by any other method of transportation that is not provided with refrigeration equipment.

These and other objects, advantages and features according to the present invention are provided by an insulated container for the storage and transport of fresh food items to keep them at a desired temperature, preferably between 0 and 4° C. The insulated container comprises a case and an insulating material lining the inside faces of the case.

The container comprises a diffuser cover provided with an independent refrigeration source connected to a thermal bridge by a support receptacle. This keeps the desired temperature inside the case for a determined period. An insulating cover fits over the diffuser cover to provide thermal insulation for the assembly.

BRIEF DESCRIPTION OF THE DRAWINGS

Other characteristics and advantages of the present invention will become clearer after reading the following description of an example embodiment with reference to the figures in which.

DETAILED DESCRIPTION OF THE PREFERRED EMBODIMENTS

Figure 1:
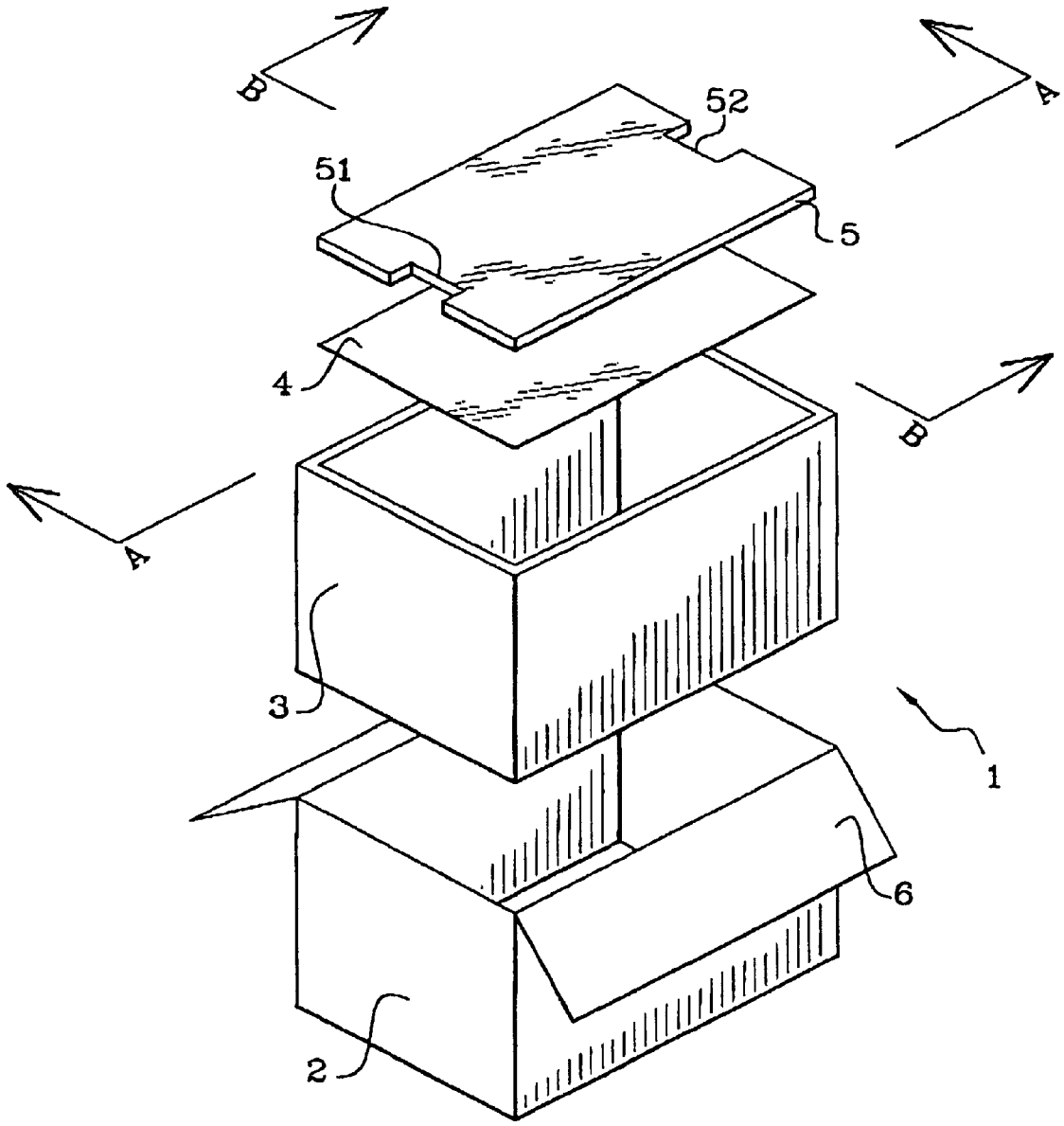
FIG. 1 is an exploded perspective view showing the different components of the insulated container according to the present invention, and the layout of these components.

FIG. 1 shows an exploded view of an insulated container 1 according to the present invention in which all of its major components are shown. The insulated container comprises a rectangular shaped case 2, preferably made of polypropylene. The case 2 is designed so that it can be inserted in other cases, is stackable and has standard outside dimensions.

A lining 3 made of an insulating material, preferably polystyrene, lines the inside of the case 2 on its four side faces and on its bottom. The insulating material lining 3 is made of a single piece, and matches the inside shape of the polypropylene case 2.

As soon as fresh food items are placed inside the case 2, a diffuser cover 4 with integrated cooling means is placed on top of the case. This keeps the temperature inside the case 2, with its insulating material lining 3, preferably between 0 and 4° C. The diffuser cover 4 will be described in more detail with reference to FIGS. 2 and 3.

An insulating cover 5 fits over the diffuser cover 4 and provides thermal insulation for the assembly, which then forms an insulated enclosure. The insulating cover 5 is preferably made of polystyrene and may advantageously be provided with two small openings 51 and 52. There is one opening on each of the two opposite edges of the cover 5 so that the cover can be easily removed.

According to one particular embodiment, the case 2 also comprises a fixed polypropylene cover 6. The cover 6 fixed to the case 2 can then be provided with closing means to seal the case when the cover 6 is closed from the top. This insures that the cooling system is not broken or opened during transport.

Figure 2:
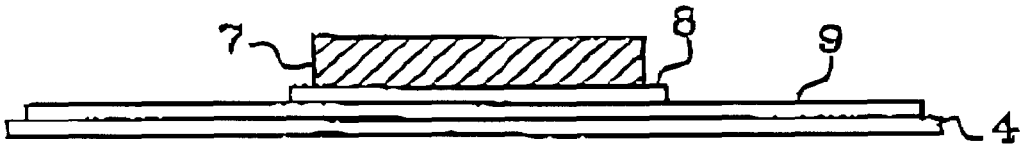
FIG. 2 is a detailed side view of the diffuser cover illustrated in FIG. 1 along line AA.

FIG. 2 shows a detailed view of the diffuser cover 4, and particularly the integrated cooling means taken along line AA in FIG. 1. The cooling means integrated in the cover 4 comprise an independent refrigeration source 7 placed on a support receptacle 8. This forms an interface between the independent refrigeration source 7 and a thermal bridge 9.

The independent refrigeration source 7 is preferably composed of carbon dioxide in solid form, which is also called dry ice, and its temperature is about −70° C. Advantageously, the thermal bridge 9 is made using a material with a low specific heat. For example, the thermal bridge may be made of aluminium.

Figure 3:
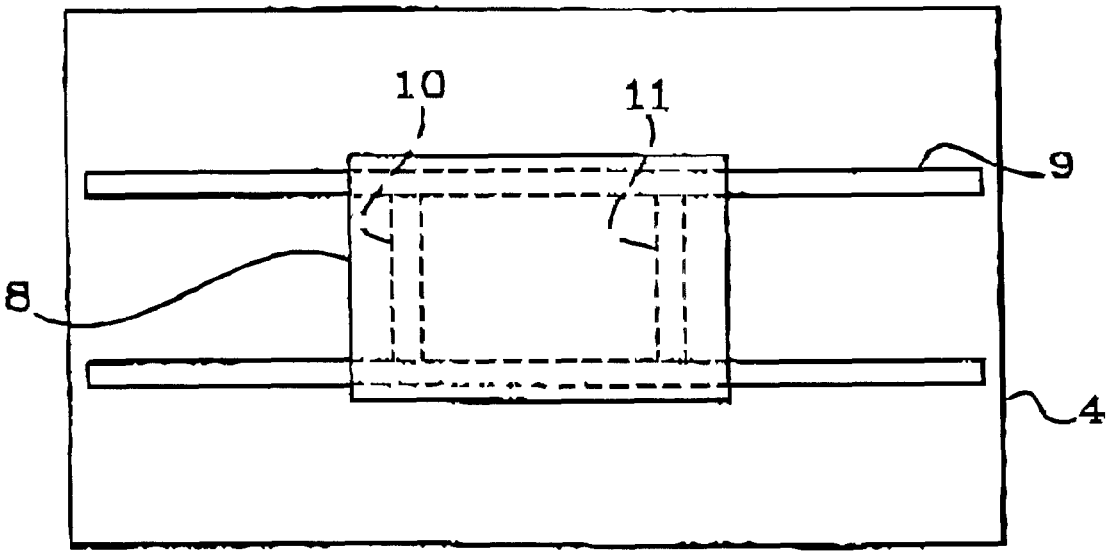
FIG. 3 is a top view of the diffuser cover illustrated in FIG. 1.

FIG. 3 shows a top view of the diffuser cover 4 provided with integrated cooling means 7, 8 and 9 in which all that is shown is the structure of the thermal bridge 9. The thermal bridge 9 thus includes a set of aluminium bars fixed to the diffuser cover 4 by glue or any other adapted attachment means. The set of aluminium bars making the thermal bridge 9 advantageously has a double H structure that extends along the entire length of the diffuser cover 4. The support receptacle 8 is then placed above it, so as to cover the two vertical bars 10 and 11 forming the double H. The two vertical bars 10 and 11 of the thermal bridge support the receptacle. Obviously, structure types other than the double H described above can be used without departing from the scope of the invention.

The function of the thermal bridge 9 is to uniformly distribute the temperature supplied by the independent refrigeration source 7 above the polypropylene case in which the fresh food items are stored. A good distribution of the temperature supplied by the refrigerating source within the case is therefore achieved by the thermal bridge 9, specifically with the particular properties mentioned above.

However, the temperature of the independent refrigeration source 7 used may be too low for the planned use of the insulated container according to the invention. Thus, the support receptacle 8 is advantageously made of a thermal insulating material. For example, polypropylene can be used.

Therefore, the support receptacle 8 for the refrigeration source 7 forms a first interface acting as thermal insulation between the independent refrigeration source and the thermal bridge 9 to decrease the temperature supplied by the refrigeration source, and thus obtain a milder diffusion. This characteristic of the support receptacle 8 of the refrigeration source 7 is achieved due to the good insulating properties of the polypropylene from which it is made.

Similarly, the diffuser cover 4 is made of a thermal insulating material and forms a second interface acting as a thermal insulation between the thermal bridge 9 and the inside of the case 2 in which the fresh food items are stored. According to one preferred embodiment, the diffuser cover 4 is made of a Plexiglas plate. The temperature supplied by the refrigeration source 7 can be further increased by the Plexiglas plate forming the cover 4. This allows the temperature to be diffused inside the case 2 to obtain the required temperature, which is preferably between 0 and 4° C.

Furthermore, the Plexiglas plate forming the diffuser cover 4 isolates food items stored inside the case from carbon dioxide that may be released by the independent refrigeration source 7. The carbon dioxide could impair the quality of the food items. Dry ice changes from a solid to a vapor at atmospheric pressure, and releases carbon dioxide gas.

In one particular embodiment of the invention, the diffuser cover 4 and the support receptacle 8 are formed from a single board of deformable thermal insulating material, preferably a honeycombed polypropylene board. A first operation includes making the thermal bridge 9 on the honeycombed polypropylene board. This is done by placing glued strips of aluminium on the surface of the board to form the double H pattern as described above with reference to FIG. 3.

However, the double H pattern is designed to be extended over only half of the total area of the board. By the use of a series of appropriate cutting and thermoforming operations, the first half of the honeycombed polypropylene board comprising the thermal bridge is shaped such that the area facing the vertical aluminium strips 10 and 11 forming the double H are banked, thus forming the support receptacle 8 for the independent refrigeration source 7.

The second half of the honeycombed polypropylene board that is not shaped is then folded under the first half of the thermoformed board so as to cover the aluminium strips forming the thermal bridge. The diffuser cover 4 thus obtained together with its thermal bridge and its support receptacle advantageously has the same characteristics as the diffuser cover obtained according to the first embodiment with reference to FIGS. 2 and 3.

This particular embodiment in which the diffuser cover 4 and the support receptacle 8 are made from a single board of honeycombed polypropylene significantly decreases its manufacturing cost so that it is possible to consider only a single use of this assembly.

Figure 4:
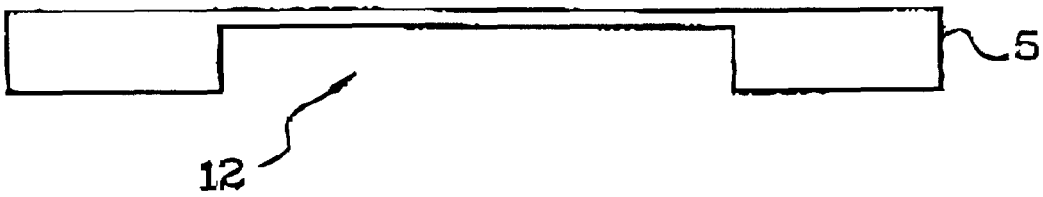
FIG. 4 is a side view of the insulating cover illustrated in FIG. 1 along line BB.

FIG. 4 shows the insulating cover 5 taken along line BB in FIG. 1. The polystyrene insulating cover 5 comprises a recess 12 at the center of the inside surface in which the dry ice 7 is placed when the insulating cover is put in place.

Therefore, the insulated container obtained according to the present invention is straightforward to make and can keep fresh food items stored at a desired temperature for several hours. Furthermore, the cooling means integrated in the diffuser cover 4 can be replaced, and the user can optimize the time during which the cooling system remains functional according to the user's needs by varying the quantity of dry ice added into the diffuser cover.

That which is claimed is:

1. An insulated container for storage and transport of fresh food items, and comprising:

an outer case having an opening therein for exposing a plurality of interior surfaces;

an inner insulated case for lining the plurality of interior surfaces of said outer case and having an opening therein for receiving the fresh food items;

a diffuser cover assembly for covering the opening of said inner insulated case, and comprising a diffuser cover, a support receptacle, a thermal bridge between said diffuser cover and said support receptable, and an independent cooling source connected to said support receptacle for maintaining a desired storage temperature within said inner insulated case; and an insulating cover to be placed on an outer surface of said diffuser cover assembly for providing thermal insulation for said inner insulated case.

2. An insulated container according to claim 1, wherein said outer case comprises polypropylene.

3. An insulated container according to claim 2, wherein said outer case further comprises a cover attached thereto for covering the opening therein; and wherein said cover comprises polypropylene.

4. An insulated container according to claim 1, wherein said inner insulated case and said insulating cover comprises polystyrene.

5. An insulated container according to claim 1, wherein said diffuser cover and said support receptacle each comprises a thermal insulating material.

6. An insulated container according to claim 1, wherein said diffuser cover and said support receptacle each comprises honeycombed polypropylene.

7. An insulated container according to claim 1, wherein said diffuser cover comprises Plexiglas.

8. An insulated container according to claim 1, wherein said support receptacle comprises polypropylene.

9. An insulated container according to claim 1, wherein said thermal bridge comprises a material with a low specific heat.

10. An insulated container according to claim 1, wherein said thermal bridge comprises aluminium and extends along a length of said diffuser cover for uniformly distributing the temperature supplied by said independent, cooling source.

11. An insulated container according to claim 10, wherein said thermal bridge comprises:

first and second spaced apart sections extending along the length of said diffuser cover; and third and fourth spaced apart sections connecting said first and second spaced apart sections together.

12. An insulated container according to claim 1, wherein said independent cooling source comprises dry ice.

13. An insulated container according to claim 1, wherein the desired storage temperature is in a range of about 0 to 40° C.

14. An insulated container comprising:

an outer case having an opening therein;

an inner insulated case for lining interior surfaces of said outer case and having an opening therein; and a diffuser cover assembly for covering the opening of said inner insulated case, said assembly comprising a diffuser cover, a support receptacle for receiving a body of dry ice and a thermal bridge between said diffuser cover and said support receptacle.

15. An insulated container according to claim 14, further comprising an insulating cover to be placed on an outer surface of said diffuser cover assembly.

16. An insulated container according to claim 14, wherein said outer case further comprises a cover attached thereto for covering the opening therein.

17. An insulated container according to claim 15, wherein said inner insulated case and said insulating cover comprises polystyrene.

18. An insulated container according to claim 14, wherein said thermal bridge comprises aluminium and extends along a length of said diffuser cover.

19. A method for forming an insulated container for storage and transport of fresh food items, the method comprising:

forming an outer case having an opening therein;

forming an inner insulated case lining interior surfaces of the outer case, and having an opening therein for receiving the fresh food items; and forming a diffuser cover assembly for covering the opening of the inner insulated case, the diffuser cover assembly comprising a diffuser cover, a support receptable, a thermal bridge between the diffuser cover and the support receptable and an independent cooling source connected to the support receptable for maintaining a desired stored temperature within the inner insulated case.

20. A method according to claim 19, further comprising forming an insulating cover to be placed on an outer surface of the diffuser cover assembly for providing thermal insulation for the inner insulated case.

21. A method according to claim 19, wherein forming the outer case further comprises forming a cover attached thereto for covering the opening therein.

22. A method according to claim 20, wherein the inner insulated case and the insulating cover each comprises polystyrene.

23. A method according to claim 19, wherein the thermal bridge comprises aluminium and extends along a length of the diffuser cover for uniformly distributing the temperature supplied by the independent cooling source.

24. A method according to claim 19, wherein the independent cooling source comprises dry ice.

* * * * *